US006070807A

United States Patent [19]

Kat et al.

[11] Patent Number: 6,070,807

[45] Date of Patent: Jun. 6, 2000

[54] WATER GEYSER ASSEMBLY

[75] Inventors: Edward Antonie Kat; Donald Gregory Reid, both of Paarl, South Africa

[73] Assignee: Fibalogic (Proprietary) Limited, Paarl, South Africa

[21] Appl. No.: 09/033,003

[22] Filed: Mar. 2, 1998

[30] Foreign Application Priority Data

Feb. 28, 1997 [ZA] South Africa ..... 97/1758

[51] Int. Cl.[7] ..... B05B 1/24; B05B 17/00; B21D 39/00; B23P 19/04

[52] U.S. Cl. ..... 239/1; 239/128; 239/133; 239/135; 239/302; 239/397.5; 29/455.1; 29/460

[58] Field of Search ..... 239/128, 133, 239/135, 302, 397.5; 29/455.1, 460

[56] References Cited

U.S. PATENT DOCUMENTS

| | | | |
|---|---|---|---|
| 2,091,838 | 8/1937 | Staak | 239/135 X |
| 3,846,616 | 11/1974 | Beck | 239/135 X |
| 4,191,304 | 3/1980 | Schiedat | 220/414 |
| 4,222,521 | 9/1980 | Nielsen | 239/135 |
| 5,169,031 | 12/1992 | Miller | 239/135 X |

FOREIGN PATENT DOCUMENTS

| | | |
|---|---|---|
| 2 425 424 | 12/1975 | Germany . |
| 82/6865 | 9/1982 | South Africa . |
| 1 585 176 | 2/1981 | United Kingdom . |
| 2 089 950 | 6/1982 | United Kingdom . |

*Primary Examiner*—Andres Kashnikow
*Assistant Examiner*—Robin O. Evans
*Attorney, Agent, or Firm*—McDermott, Will & Emery

[57] ABSTRACT

A water geyser assembly comprises an inner pressurizable container and an outer shell both formed from a glass fibre reinforced plastics material. A polyurethane foam material fills the void defined between the inner container and the shell. A fitting mounting land formed with a number of apertures is provided at one end of the inner container for receiving fittings in the form of a pair of flanged spigot portions which are externally threaded and which are bridged at the flange. The flange locates against an inner surface of the fitting mounting land via sealing rings, and lock nuts are screwed down over each of the threaded spigot portions which project through the apertures so as to form a pressure tight fit. The fittings are thus locked mechanically to the mounting land without being laid in glass fibre during manufacture. Water inlet and outlet conduits, a heating element assembly and a pressure relief valve are in turn mounted in communication with the spigot portions.

10 Claims, 5 Drawing Sheets

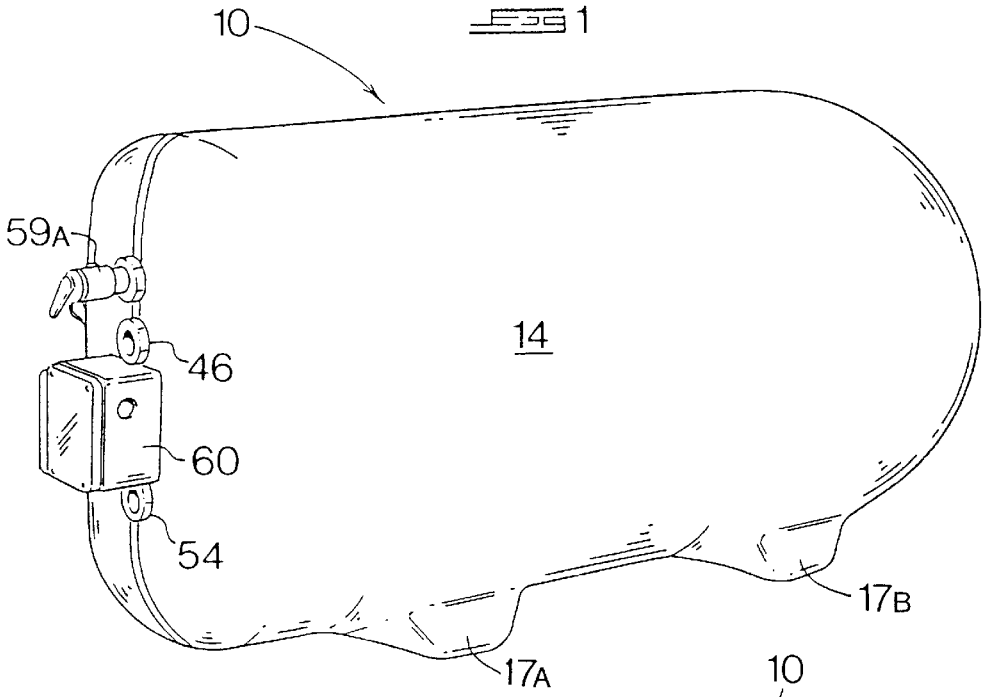
10
1
59A
46
14
60
54
17B
17A
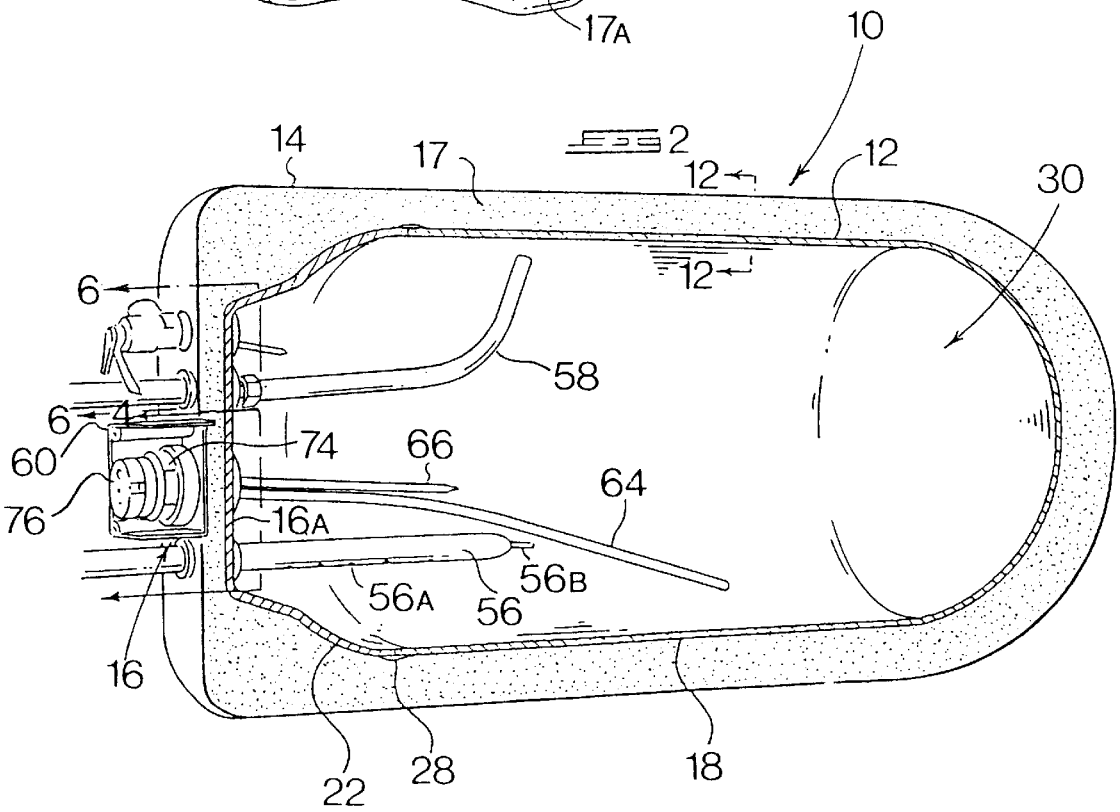
10
14
17
2
12
12
30
12
6
58
6
4
60
74
66
76
64
16A
56B
56A
56
16
22
28
18

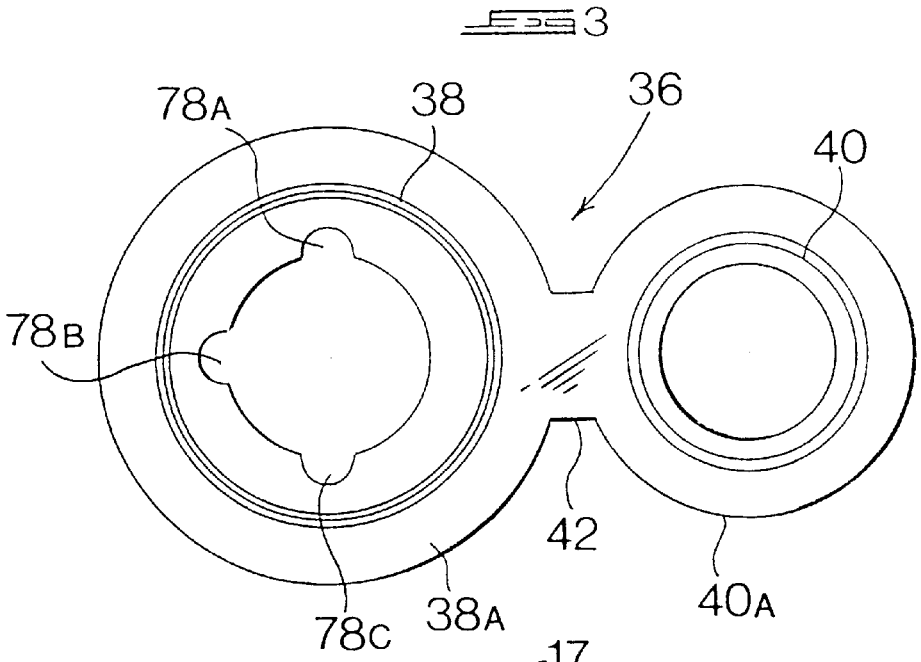
3
78A
38
36
40
78B
42
78C
38A
40A
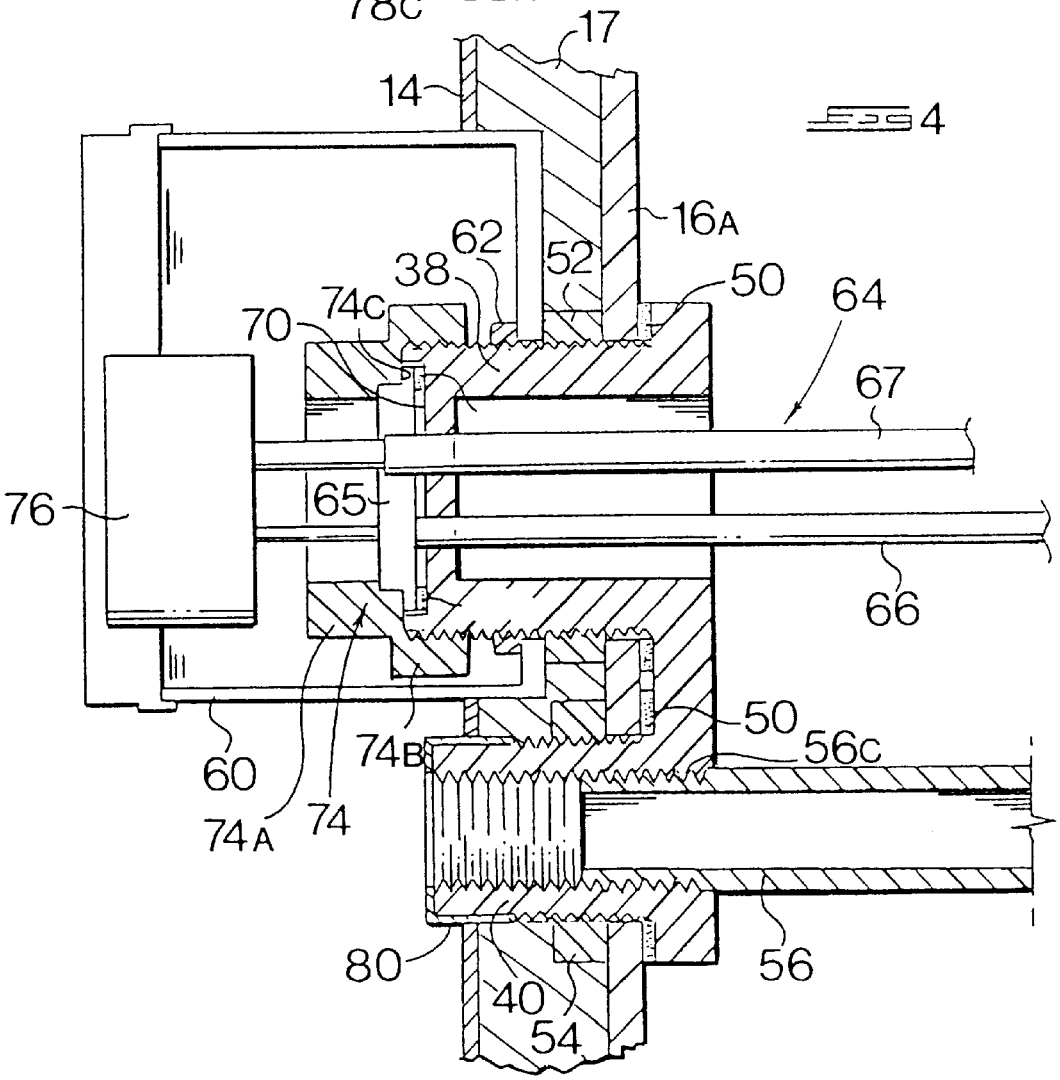
17
14
4
16A
62
52
38
50
64
74C
70
67
76
65
66
50
56C
60
74B
74A
74
80
40
54
56

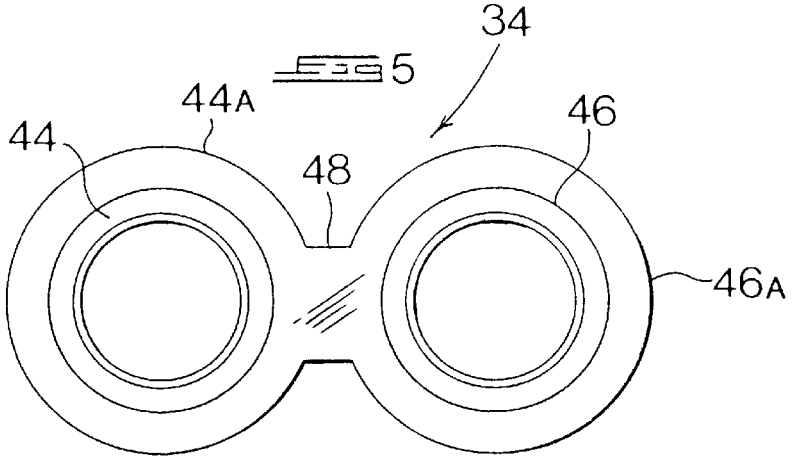
34
5
44A
46
44
48
46A
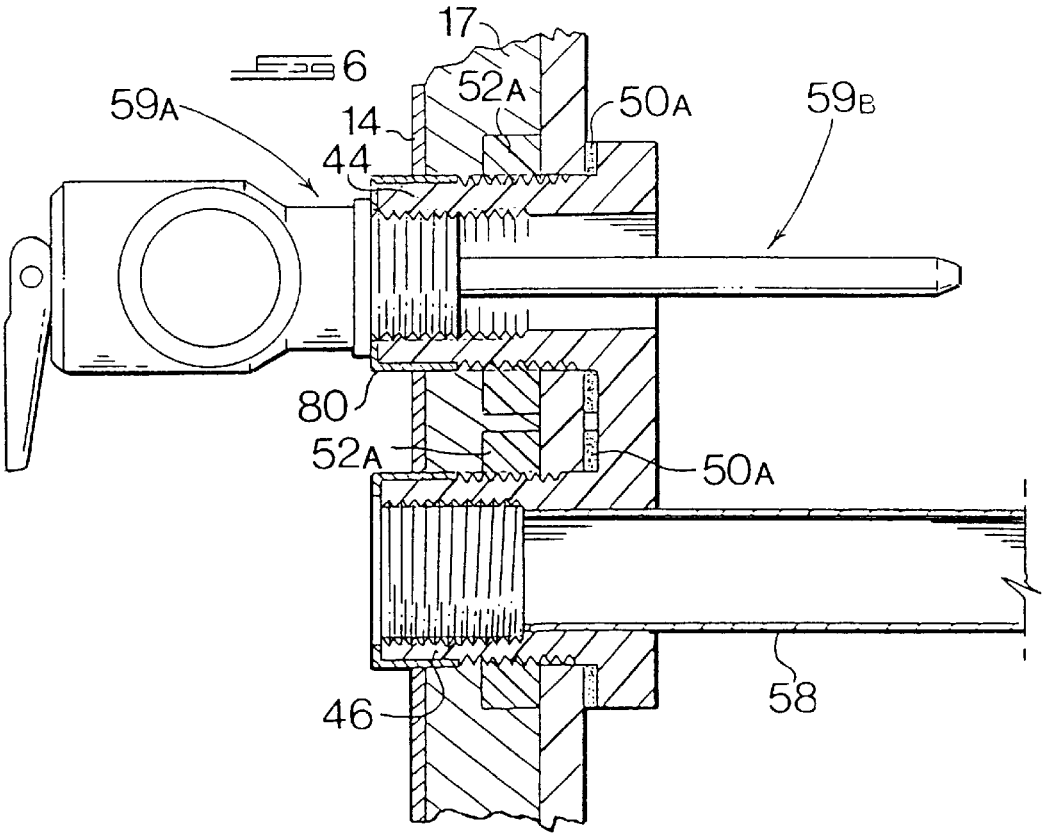
17
6
52A
50A
59B
59A
14
44
80
52A
50A
46
58

WATER GEYSER ASSEMBLY

BACKGROUND TO THE INVENTION

THIS invention relates to a water geyser assembly.

Various different types of water geyser assemblies are known. Such assemblies are predominantly formed from metal, and are prone to rust. Sacrificial anodes merely serve to delay rather than to solve the rust problem.

Various fibre reinforced plastics material, and in particular glass fibre reinforced plastics materials have in the past been used with a view to overcoming the rust problem, such as the geyser disclosed in South African patent 82/6865. A problem associated with pressurized geysers of this type is that zones of weakness tend to develop, in particular at the interface between the geyser and the geyser fittings.

SUMMARY OF THE INVENTION

According to a first aspect of the invention there is provided a water geyser assembly comprising an inner pressurizable container formed from a glass fibre reinforced plastics material, an outer shell formed from a glass fibre reinforced plastics material, an insulating foam material substantially filling a space defined between an outer surface of the inner container and an inner surface of the outer shell, a fitting mounting land being provided at one end of the inner container and including a plurality of apertures, at least one fitting including spigot portions extending through the corresponding apertures, the fitting being locked mechanically to the mounting land in a pressure tight fit without being laid in glass fibre during manufacture, and a plurality of corresponding accessories being mounted in communication with the spigot portions of the fitting and protruding into the inner container, the accessories including a water inlet conduit, a water outlet pipe, and a heating element assembly.

Preferably, the at least one fitting includes a bridge portion interconnecting a pair of spigot portions for rendering the spigot portions non-rotatable within the corresponding apertures through which they extend.

Advantageously, the spigot portions are externally threaded, a flange extends from each spigot portion and is adapted to locate against an inner surface of the fitting mounting land via sealing means, and lock nuts are screwed down over each of the threaded spigot portions against an outer surface of the fitting mounting land so as to form the pressure tight fit.

Conveniently, the at least one fitting includes a first fitting to the spigot portions of which are mounted the water outlet pipe and a temperature and pressure probe communicable with a relief valve.

In a preferred form of the invention, the at least one fitting includes a second fitting to the spigot portions of which are mounted the water inlet conduit and the heating element assembly.

Typically, the heating element assembly is mounted in position by means of a mounting assembly including an externally threaded heating element assembly spigot within which is defined a platform shaped to accommodate the heating element assembly in a non-rotating fit, a first lock nut for forming, in conjunction with a first sealing ring, a first pressure tight fit between the mounting land and the fitting, and a second lock nut for forming, in conjunction with a second sealing ring, a second pressure tight fit between the fitting and a base of the element assembly.

The invention extends to a method of manufacturing a water geyser assembly comprising the steps of:

a) forming a domed inner container head portion from a glass fibre reinforced plastics material, the head portion having a fitting mounting land defined therein, and an opposed open end;

b) forming a plurality of fitting apertures in the fitting mounting land;

c) providing at least one fitting having at least one spigot portion;

d) passing the spigot portion through a corresponding aperture and locking it mechanically to the mounting land in a pressure tight fit;

e) forming a round cylindrical inner container body portion having an open end and a domed end;

f) bonding the open end of the body portion to the open end of the head portion by means of an annular glass fibre and resin bonding structure so as to form the inner container;

g) forming a pair of outer shell halves from glass fibre reinforced plastics material; and h) placing the outer shell halves around the inner container and introducing a foam material into a void defined between the inner container and the outer shell halves.

Preferably, the method includes the step, prior to joining the body and head portions, of mechanically mounting a plurality of accessories in communication with the or each spigot portion so that they extend towards the open end of the head.

Advantageously, the at least one fitting includes a pair of externally threaded spigot portions, a flange extending from each spigot portion, and a bridge portion interconnecting the pair of spigot portions, the method including the steps of passing the spigot portions through the corresponding apertures and locating the flanges against an inner surface of the fitting mounting land via sealing means.

Conveniently, the method includes the subsequent steps of screwing down lock nuts over each of the threaded spigot portions against an outer surface of the fitting mounting land so as to form the pressure tight fit.

BRIEF DESCRIPTION OF THE DRAWINGS

FIG. 1 shows a perspective view of a water geyser assembly of the invention, FIG. 2 shows a longitudinal cross-sectional perspective view along the line 2—2 of FIG. 1;

FIG. 3 shows a top plan view of a first lower fitting forming part of the geyser assembly;

FIG. 4 shows a cross-sectional detail of the assembled fitting of FIG. 3 along the line 4—4 of FIG. 2;

FIG. 5 shows a top plan view of an upper second fitting forming part of the water geyser assembly;

FIG. 6 shows a cross-sectional detail of the assembled fitting of FIG. 5 along the line 6—6 of FIG. 2;

DESCRIPTION OF EMBODIMENTS

Figure 7:
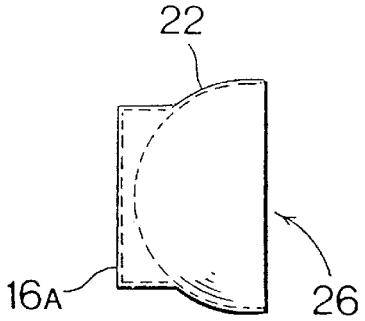
FIG. 7 shows a side view of a head portion of the geyser assembly.
Figure 8:
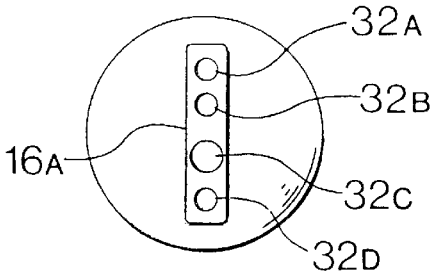
FIG. 8 shows an end-on view of the head portion of FIG. 7.
Figure 9:
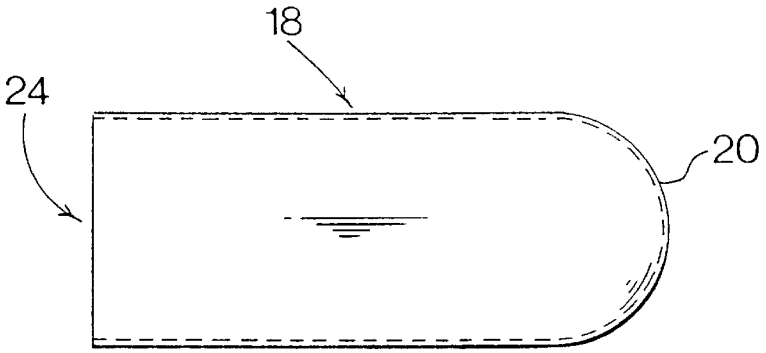
FIG. 9 shows a side view of a cylinder portion of the geyser assembly.
Figure 10:
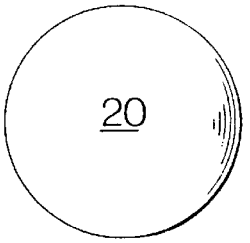
FIG. 10 shows an end-on view of the cylinder portion.

Referring first to FIGS. 1 and 2, a water geyser assembly 10 includes an inner container 12, an outer shell 14 and a component connection zone 16 having a flat rectangular component mounting land 16A. Both the inner container 12 and the outer shell 14 are formed from glass fibre reinforced plastics material, and an insulating foam material in the form of a polyurethane foam 17 occupies the void between the outer surface of the inner container 12 and the inner surface of the outer shell 14, which is formed with a pair of feet 17A and 17B for allowing the geyser to rest in a horizontal configuration.

As is clear from FIGS. 7 to 10, the inner container 12 is formed from a round cylindrical body 18 having a hemispherical end 20 and a hemispherical head portion 22 from which the integral rectangular component fitting zone 16 projects. The opposed open ends 24 and 26 of the respective cylindrical body 18 and the head 22 are joined together by means of an annular glass fibre and resin bonding structure 28. A space 30 is defined within the inner container for receiving water under pressure, typically at pressures of between 100 kPa and 400 kPa, with the space 30 generally having a capacity of 0.1 cubic meters in the case of a 1001 geyser, and 0.15 cubic meters in the case of 1501 geyser.

Referring now to FIGS. 1 and 2 in conjunction with FIGS. 3 to 6, four circular apertures 32A, 32B, 32C and 32D are drilled through the component mounting land 16A, with the upper two apertures 32A and 32B being arranged to receive an upper fitting 34, the lower two apertures 32C and 32D being arranged to receive a lower fitting 36. Each of these fittings are injection moulded from a hard and heat resistant plastics material such as a glass reinforced Zytel® resin. Both of the fittings have a figure-of-eight format, with the lower fitting 36 comprising two hollow cylindrical bodies or spigots 38 and 40 extending from respective base flanges 38A and 40A which are joined by an interconnecting bridge 42. The upper fitting 34 is similarly provided with hollow cylindrical spigots 44 and 46 extending from base flanges 44A and 46A joined by a bridge 48.

During assembly, and as is clear from FIG. 4, silicone rubber sealing rings 50 are fitted against the spigot flanges, after which the spigots 38 and 40 of the lower fitting are passed through the respective apertures 32C and 32D. Hexagonal lock nuts 52 and 54 are then screwed on tightly over the threaded spigots, with the lock nut 52 being tightened to a 45 Nm torque, and the smaller lock nut 54 being tightened to a 35 Nm torque. The same procedure is followed with respect to the upper fitting 34, using sealing rings 50A and lock nuts 52A.

The mounting of the fittings is preceded by the following preparatory steps. A 25 mm PVC inlet conduit 56 is prepared by cutting 8 mm holes 56A into the bottom end of the conduit, crimping the free end of the conduit at 56B and tapping a thread 56C into the fixed end of the conduit, which is subsequently screwed into the internally threaded spigot 40. A copper outlet pipe 58 is bent into shape, and is press fitted within the internally threaded spigot 46.

An electrical box 60 is then installed over the spigot 38 using a lock nut 62. A heating element assembly 64 including a base 65, a downwardly bent heating element 66 and a thermostat pocket 67 is then prepared. An annular heating element gasket 68 is positioned against a recessed platform 70 defined in the outer face of the spigot 38. The heating element assembly 66 is then mounted in position, with the inner face of the head 65 of the element assembly abutting against the gasket 68. An element nut 74 is then screwed down over the element head. The element nut 74 has a hex portion 74A and an internally threaded flange 74B, with an internal shoulder 74C extending therebetween. An internal shoulder 74C of the nut abuts firmly against the outer face of the element head 65. A thermostat 76 is then inserted into the thermostat sleeve 66.

The positioning of the heating element assembly 64 within the fitting 36 is facilitated by three part circular indentations 78A, 78B and 78C defined within the recessed platform 70, with the indentations 78B accommodating the thermostat sleeve 67 and the indentation 78A and 78C accommodating opposite arms of the heating element 66 in a snug non-rotational fit.

The figure-of-eight configuration of the upper and lower fittings 34 and 36 means that they cannot rotate individually when the lock nuts are tightened. This ensures that the alignment of the components is accurate and is uniform. In addition, the assembly process is speeded up, in that only two fittings are required. This also leads to simplification in stock holding requirements, as well as avoiding the possibility of the wrong fitting being inserted into the wrong aperture.

In order to increase the burst strength of the fittings, the ends of the spigots 38, 40, 44 and 46 are provided with aluminium collars 80 which are pressfitted into position.

Once the various components have been fitted to the head 22, the head is then joined to the cylindrical body 18 by means of the bonding structure 28, which includes alternating layers of tissue, fibreglass and cloth roving strips bonded together using epoxy vinyl esther resin.

A temperature and pressure valve 59A from which a temperature and pressure sensing probe 59B extends is then screwed into position within the spigot 44 using Lokprep® to fix it securely to the valve thread. The bonded tank is then tested to about 600 kPa, after which the pressure is increased to about 700 kPa to check that the valve opens.

Figure 11:
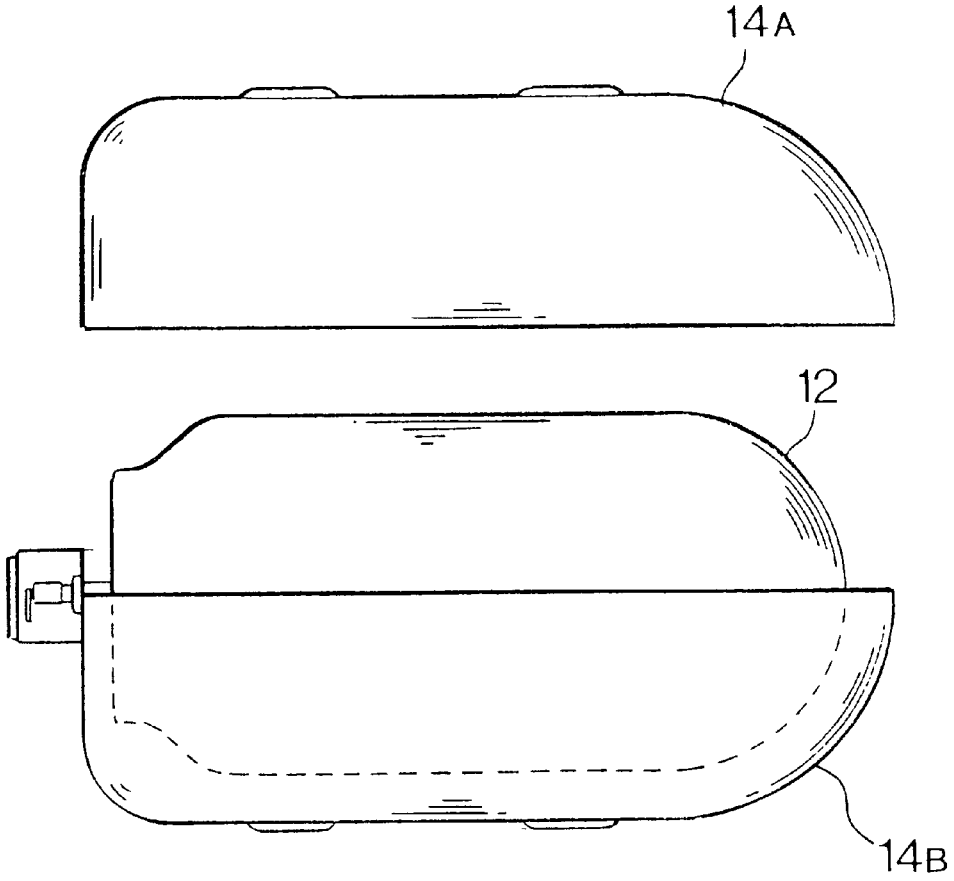
FIG. 11 shows a top plan view of the water geyser assembly of FIG. 1 prior to placement of one of the outer shell halves.
Figure 12:
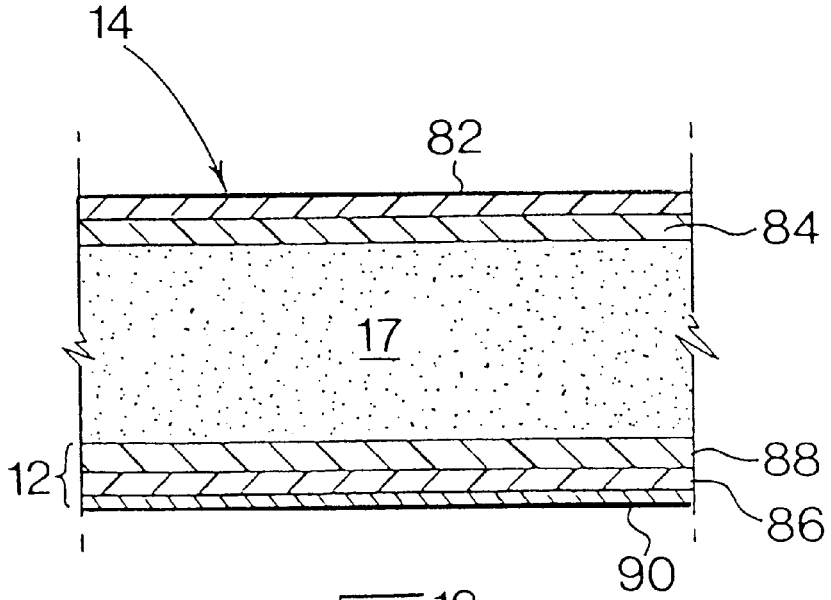
FIG. 12 shows a more detailed cross-sectional view through the walls of the geyser on the line 12—12 of FIG. 1.

Referring now to FIG. 11, two outer shell halves 14A and 14B are moulded using a resin transfer moulding system, and, as is clear from FIG. 12, include an outer UV resistant gelcoat 82 and an inner chop strained mat of glass fibre and resin 84. The outer shell halves 14A and 14B are placed around the inner container 12 in a foaming mould and are formed with cutouts for accommodating the fittings, with the inner container 12 being supported in the correct position. The polyurethane foam 17 is then introduced into the void between the container 12 and the outer shell 14 and is allowed to cure. The mounting feet 17A and 17B are also filled during the foaming process.

Referring now to FIG. 12, the inner container wall 12 is constructed from an inner layer 86 made up of resin rich 30% by mass glass fibre and 70% by mass epoxy vinyl esther resin, and an outer layer 88 made up of 30% epoxy vinyl esther resin and 70% of chop strained glass fibre mat. A chemically resistant tissue 90 is located on the innermost surface of the inner container 12 for covering the exposed layers of glass fibre and preventing wicking from taking place through exposed fibres.

The mechanical connection of the fittings overcomes the disadvantages of the prior art, where such fittings are glassed in integrally with the fibreglass laminate. As the laminate and the fittings have different thermal expansion coefficients, as the temperature of the geyser fluctuates from room temperature to 100° C. or more, with the continual expansion and contraction of the laminate and the fittings resulting in cracks and voids appearing at the interface between the fittings and the laminate. This creates weakened zones which ultimately weaken the overall structure of the geyser and result in it not being able to withstand even normal operating pressures of around 400 kPa.

In the case of the present invention, the mariner in which the fittings are mechanically mounted with sealing rings providing the necessary play so as to cater for the different thermal expansion coefficients of the laminated fibreglass wall and the fittings extending through the wall.

We claim:

1. A water geyser assembly comprising an inner pressurizable container formed from a glass fibre reinforced plastics material, an outer shell formed from a glass fibre reinforced plastics material, an insulating foam material substantially filling a space defined between an outer surface of the inner container and an inner surface of the outer shell, a fitting mounting land being provided at one end of the inner container and including a plurality of apertures, at least one fitting including spigot portions extending through the corresponding apertures, the fitting being locked mechanically to the mounting land in a pressure tight fit without being laid in glass fibre during manufacture, and a plurality of corresponding accessories being mounted in communication with the spigot portions of the fitting and protruding into the inner container, the accessories including a water inlet conduit, a water outlet pipe, and a heating element assembly.

2. A water geyser assembly according to claim 1 in which the at least one fitting includes a bridge portion interconnecting a pair of spigot portions for rendering the spigot portions non-rotatable within the corresponding apertures through which they extend.

3. A water geyser assembly according to claim 1 in which the spigot portions are externally threaded, a flange extends from each spigot portion and is adapted to locate against an inner surface of the fitting mounting land via sealing means, and lock nuts are screwed down over each of the threaded spigot portions against an outer surface of the fitting mounting land so as to form the pressure tight fit.

4. A water geyser assembly according to claim 3 in which the at least one fitting includes a first fitting to the spigot portions of which are mounted the water outlet pipe and a temperature and pressure probe communicable with a relief valve.

5. A water geyser assembly according to claim 4 in which the at least one fitting includes a second fitting to the spigot portions of which are mounted the water inlet conduit and the heating element assembly.

6. A water geyser assembly according to claim 5 in which the heating element assembly is mounted in position by means of a mounting assembly including an externally threaded heating element assembly spigot within which is defined a platform shaped to accommodate the heating element assembly in a non-rotating fit, a first lock nut for forming, in conjunction with a first sealing ring, a first pressure tight fit between the mounting land and the fitting, and a second lock nut for forming, in conjunction with a second sealing ring, a second pressure tight fit between the fitting and a base of the element assembly.

7. A method of manufacturing a water geyser assembly comprising the steps of:

a) forming a domed inner container head portion from a glass fibre reinforced plastics material, the head portion having a fitting mounting land defined therein, and an opposed open end;

b) forming a plurality of fitting apertures in the fitting mounting land;

c) providing at least one fitting having at least one spigot portion;

d) passing the spigot portion through a corresponding aperture and locking it mechanically to the mounting land in a pressure tight fit;

e) forming a round cylindrical inner container body portion having an open end and a domed end;

f) bonding the open end of the body portion to the open end of the head portion by means of an annular glass fibre and resin bonding structure so as to form the inner container;

g) forming a pair of outer shell halves from glass fibre reinforced plastics material; and h) placing the outer shell halves around the inner container and introducing a foam material into a void defined between the inner container and the outer shell halves.

8. A method according to claim 7 which includes the step, prior to joining the body and head portions, of mechanically mounting a plurality of accessories in communication with the or each spigot portion so that they extend towards the open end of the head.

9. A method according to claim 7 in which the at least one fitting includes a pair of externally hreaded spigot portions, a flange extending from each spigot portion, and a bridge portion interconnecting the pair of spigot portions, the method including the steps of passing the spigot portions through the corresponding apertures and locating the flages against an inner surface of the fitting mounting land via sealing means.

10. Method according to claim 9 which includes the subsequent steps of screwing down lock nuts over each of the threaded spigot portions against an outer surface of the fitting mounting land so as to form the pressure tight fit.

* * * * *